United States Patent [19]

Kang

[11] Patent Number: 4,788,077

[45] Date of Patent: Nov. 29, 1988

[54] THERMAL SPRAY COATING HAVING IMPROVED ADDHERENCE, LOW RESIDUAL STRESS AND IMPROVED RESISTANCE TO SPALLING AND METHODS FOR PRODUCING SAME

[75] Inventor: Chih-Tsung Kang, Indianapolis, Ind.

[73] Assignee: Union Carbide Corporation, Danbury, Conn.

[21] Appl. No.: 64,530

[22] Filed: Jun. 22, 1987

[51] Int. Cl.[4] ..... B05D 1/08

[52] U.S. Cl. ..... 427/34; 427/423

[58] Field of Search ..... 427/34, 423

[56] References Cited

U.S. PATENT DOCUMENTS

| | | | |
|---|---|---|---|
| 2,714,563 | 8/1955 | Poorman et al. | 117/105 |
| 2,858,411 | 10/1958 | Gage | 219/75 |
| 2,861,900 | 11/1958 | Smith et al. | 117/105 |
| 2,950,867 | 8/1960 | Hawley et al. | 239/13 |
| 3,016,447 | 1/1962 | Gage et al. | 219/76 |
| 3,684,942 | 8/1972 | Pettit, Jr. et al. | 321/5 |
| 3,694,619 | 9/1972 | Nahuijsen et al. | 219/130 |
| 3,914,573 | 10/1975 | Muehlberger | 219/76 |
| 3,935,418 | 1/1976 | Stand et al. | 219/121 P |
| 3,958,097 | 5/1976 | Fabel et al. | 219/76 |
| 3,988,566 | 10/1976 | Vogts et al. | 219/121 P |
| 4,173,685 | 11/1979 | Weatherly | 428/556 |
| 4,265,930 | 5/1981 | Shinohara et al. | 427/34 |
| 4,275,124 | 6/1981 | McComas et al. | 427/34 |
| 4,302,482 | 11/1981 | Heck | 427/34 |
| 4,451,496 | 5/1984 | Gedwill et al. | 427/34 |
| 4,519,840 | 5/1985 | Jackson et al. | 106/1.05 |
| 4,600,599 | 7/1986 | Wallstén | 427/34 |
| 4,642,440 | 2/1987 | Schnachel et al. | 427/34 |

*Primary Examiner*—Norman Morgenstern
*Assistant Examiner*—Marianne L. Padgett
*Attorney, Agent, or Firm*—Cornelius F. O'Brien

[57] ABSTRACT

Method of thermal spray coating a substrate by projecting heat-softened particles onto said substrate including the steps of contacting particles to be projected and coated onto the substrate with a body of hot gases, heating the particles in the hot gases to a temperature near, at or above their melting point and impinging the heated particles against the substrate to provide a coating having the desired thickness wherein said particles are first heated to a relatively higher temperature and impinged onto the substrate to provide a first layer having a thickness that is a fraction of the desired thickness and thereafter heating coated particles to a lower temperature in the hot gases and impinging them on the first layer to provide a second layer having a thickness which together with the thickness of the first layer equals the desired thickness. The invention also includes the resulting coated substrates.

16 Claims, 1 Drawing Sheet

THERMAL SPRAY COATING HAVING IMPROVED ADDHERENCE, LOW RESIDUAL STRESS AND IMPROVED RESISTANCE TO SPALLING AND METHODS FOR PRODUCING SAME

FIELD OF THE INVENTION

This invention relates to coatings on substrates having improved adherence to the substrate, low residual stress and improved resistance to spalling, methods for producing same and coated articles.

BACKGROUND OF THE INVENTION

Thermal spray coating methods are known wherein a powder comprising particles of the material to be coated onto the surface of the substrate is fed into a body of hot gases where the particles are heated to a temperature sufficiently high to soften same, e.g., by melting or heat-plastification, and thereafter the heat-softened (e.g. molten) particles are impinged against the substrate to be coated for a total period of time sufficient to provide a coating having a desired thickness. The body of hot gases can be formed by any suitable means, for example, by passing an inert gas through an electric arc as is accomplished in plasma torch coating procedures, or by detonating fuel gas-oxygen mixtures in a detonation gun (D-gun), or by the combustion of the fuel gas oxygen mixtures in a continuous flame spray device. The heat-softened particles are projected against and coated onto the substrate (surface to be coated) and on impact form a coating comprising many layers of overlapping, thin, lenticular particles or splats. Almost any material that can be melted without decomposing can be used as the coating particles. Typically, the substrate is passed before the plasma torch or D-gun or other hot gas producing device for a number of passes sufficient to build up a coating of the desired thickness. Typical coating thicknesses range from 0.002 to 0.02 inch, but in some applications may be as high as and exceed 0.2 inch.

Thermal spraying processes have been found to be extremely useful in providing hard, tough and/or highly abrasion resistant, oxidation resistant, and/or corrosion resistant coatings to a wide variety of substrates, e.g., working surfaces such as cutting tools and the like and airfoils such as turbine and fan blades, vanes and the shrouds for turbo machines. In general, however, thermal sprayed coatings are subject to two types of failure. For the Type I failure, the coating does not have good adherence to the substrate and therefore spalls along the interface between the coating and the substrate. In a Type II failure, the separation occurs between layers in the coating itself, and/or cracking occurs within the coating, and results from high residual tensile stresses in the coating. In certain types of coatings, there is a tendency to spall in a Type I failure and a great deal of research has been done in the area of improving bonding of the coating to the substrate.

Three types of bonding have been reported for thermal sprayed coatings including (1) chemical (metallurgical) bonding, (2) mechanical interlocking, and (3) physical bonding (Van der Waals force). In general, mechanical interlocking and metallurgical bonding are more important than physical bonding in most cases of bonding the coating to the substrate by thermal spraying.

The coatings formed by thermal spray methods comprise a plurality of overlapping "splats" formed by the impact of the heat-softened particles against the substrate. Residual tensile stress occurs in thermal spray coatings as a result of the cooling of the individual "splats" from near or above their melting point to the temperature of the substrate. The magnitude of the residual stress is a function of the equipment parameters, e.g., the arc, D-gun, or continuous flame spray device parameters, the temperature to which the powder particles are heated, the deposition rate, the relative substrate surface speed, the thermal properties of both the coating and the substrate, the substrate's temperature, and the amount of auxiliary cooling used. It has also been found that the use of finer powders leads to higher residual tensile stresses which, however, can be controlled by adjusting the coating parameters. If the substrate temperature is allowed to rise above room temperature, a secondary change in the state of stress of the coating may occur as both the substrate and the coating cool to room temperature due to the differences in thermal expansion. Residual tensile force also increases with coating thickness above some minimal initial thickness. The rate of increase, however, is a function of the deposition parameters and the coating material. Residual tensile stress also has a significant effect on bond strength. Coatings are normally in tension.

When a given coating is to be applied to a given substrate, the skilled worker customarily conducts a series of trials to first determine the process conditions or parameters that optimize properties in the coating such as adhesion of the coating to the substrate, high deposition efficiency, density, and stress. In this optimization, or trial and error, procedure, the temperature of the hot gas, e.g., plasma, and thus the temperature to which the coating particles is raised, is varied by varying the power input into the plasma producing device. In the case of the plasma torch, the plasma temperature is raised by increasing the amperage or current used to produce the arc and lowered by decreasing the amperage or current, or the power input to the plasma can be changed by varying the gas composition. In the D-gun the hot gas temperature is reduced by reducing the oxygen carbon ratio in the range of 1.5 to 1, and/or increasing the amount of diluent, i.e., non-combustible gas fed relative to the amount of combustible gas, e.g., acetylene and oxygen being employed and is increased by reducing or eliminating the amount of the inert gas diluent. In the continuous flame spray device, the hot gas temperature can be controlled by varying the flow rate and/or oxygen to fuel ratio. Higher than optimum hot gas temperatures introduce higher amounts of residual tensile stress in the coating which, in the extreme, results in cracked, weak or broken coatings. Furthermore, coatings produced using higher than optimum hot gas temperature may contain more oxide inclusions and may undergo changes in chemical composition compared to the chemical composition of the powder employed. Additionally, the prolonged generation of higher than optimum plasma temperatures can reatly reduce the life of the anodes when electric arc plasma torches are used. Lower than optimum hot gas temperatures produce coatings having lower adhesion to the substrate rendering them more prone to Type I failures. After the optimum parameters are established the coatings can be applied on a production scale.

There are instances where optimum parameters cannot be found (do not exist) for coating a particular substrate with a particular coating to result in acceptable levels of adherence and residual stress. It has been the practice in such instances to utilize a bond coat applied to the substrate before the particular coating is applied. In many of these instances, it is possible to adequately bond the coating to the substrate to provide acceptable levels of adherence and residual stress. However, the procedure of applying a bond coat is more expensive, troublesome and time consuming. For example, the bond coat requires either a separate hot gas enerating device, one for the bond coat and the other for the coating, or, if the same hot gas generating device is used, it must be cleansed of the bond coat particles and recharged with the coating particles. In addition, temperature changes of the bond-coated substrate during transit to the separate hot gas generating device for applying the coating or while awaiting completion of cleaning and recharging of the same hot gas generating device, can introduce additional variables and may result in new problems.

There also are instances in which suitable optimum parameters can't be found or do not exist and a suitable bond coat cannot be found to provide the required levels of adhesion and residual stress of certain coatings applied on certain substrates. In such cases, there appear to be no means available in the art, heretofore, for adequately bonding such coatings to such substrates.

Referring to specific prior art, thermal spray coatings have been known for many years; detonation gun coating procedures are described in U.S. Pat. No. 2,714,563, plasma torch processes are described in U.S. Pat. Nos. 2,858,411 and 3,016,447, and continuous flame spray processes with fuel gas-oxygen or fuel gas-air combustion are described in U.S. Pat. No. 2,861,900, the disclosures of these patents being incorporated herein by reference.

U.S. Pat. No. 3,914,573 describes an electric arc plasma spray gun which projects a stream of plasma containing entrained particles of coating material at a velocity of about Mach 2 to provide enhanced coatings.

U.S. Pat. No. 3,958,097 discloses a process for high velocity plasma flame spraying of a powder onto a substrate utilizing a special nozzle construction resulting in the formation of shock diamonds for providing an increased deposit efficiency and higher powder feed rates into the plasma.

U.S. Pat. No. 3,988,566 describes an automatic plasma flame spraying process and apparatus in which the current is automatically increased during start-up to offset current decrease caused by the secondary gas and vice-versa during shutdown procedures.

U.S. Pat. No. 4,173,685 discloses a coating material containing carbides and a nickel containing base alloy having 6 to 18% boron and coatings obtained therefrom using plasma or D-gun techniques. U.S. Pat. No. 4,519,840 discloses a coating composition containing cobalt, chromium, carbon and tungsten and application of the coating composition by D-gun or plasma torch techniques.

U.S. Pat. No. 3,935,418 describes a plasma spray gun having an external, adjustable powder feed conduit so that powder is applied to the flame of the gun after it has left the gun nozzle. U.S. Pat. Nos. 3,684,942 and 3,694,619 disclose welding apparatus in which arc current is controlled by suitable means.

U.S. Pat. No. 2,861,900 describes continuous flame spray device for applying surface coatings to articles.

None of the above-identified prior art references disclose a thermal spray coating method which is carried out in first and second stages a single coating material wherein, in the first stage, the temperature of the coating particles impinged onto the substrate is substantially higher than the temperature of the coating particles in the second stage to provide a first layer having a thickness that is less than the desired thickness of the coating; and, the temperature of the coating particles impinged, in the second stage, onto the first layer is substantially lower than that of the hot coating particles in the first stage.

SUMMARY OF THE INVENTION

The present invention relates to a method of thermal spraying a multilayer coating on a substrate by projecting heat-softened particles onto said substrate comprising the steps of:

(a) establishing a body of hot gases, (b) contacting said hot gases with particles to be projected and coated onto said substrate, (c) heating said particles in said hot gases to a temperature above their melting point, (d) impinging said heated particles against said substrate for a period of time sufficient to provide a first layer of a coating on said substrate, (e) reducing the heat of said particles in said hot gases to a temperature below that of step (c) but above about their melting point, and (f) impinging said heated particles on said first layer to provide an overall layer having good adhesion to said substrate. Preferably the temperature of the particles in step (c) is at least 10 percent higher than the temperature of the particles in step (e).

As used herein a first layer and a second layer shall mean a first layer having one or more layers and a second layer having one or more layers, respectively.

The method of the present invention is performed wherein the coating particles are heated in the first stage (step c) to a temperature at least 10% higher than the temperature to which they are heated in a second stage (step e) and are impinged onto the substrate to provide a first layer which covers the surface desired to be coated. In the second stage, the temperature of the hot gases is lower than the temperature of the hot gases in the first stage and, preferably, is at or near the optimum temperature for applying the coating. In the second stage, the softened particles are impinged upon the first layer or layers on the substrate to provide on the first layer or layers a second layer of layers of a total thickness equal to the difference between the desired or optimum thickness and the thickness of the first layer or layers; i.e., the sum of the thicknesses of the first and second layers is equal to the desired or optimum thickness for a given application.

The invention also provides coated articles having substrates coated pursuant to the novel method.

The method of the present invention provides coatings having improved adhesion to the substrate, low residual stress and improved resistance to spalling or cracking of the coating. The advantages of this invention are useful to improve adhesion, lower residual tensile stress and improve resistance to spalling or cracking of coatings applied directly to substrates as well as those applied to bond coats applied to the substrate. In the latter case, the bond coat can be eliminated entirely, resulting in savings of time, effort and costs.

DESCRIPTION OF THE PREFERRED EMBODIMENTS

Figure 1:
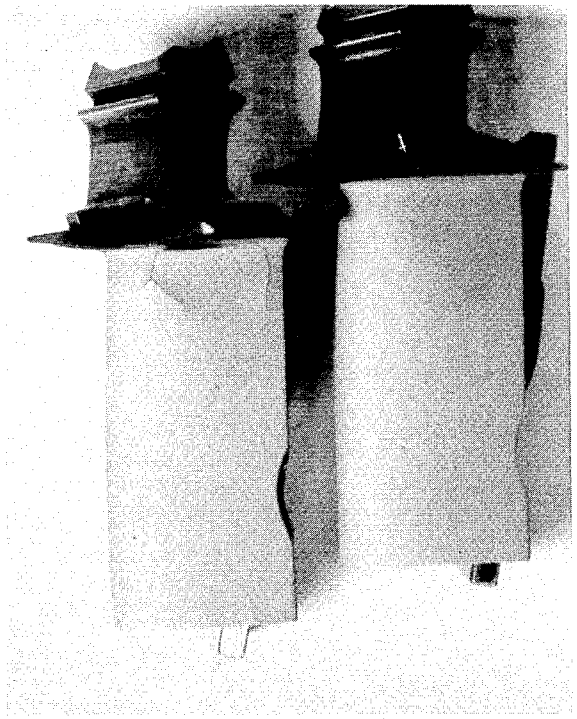
FIG. 1 is a photograph showing the convex side of two blades, the upper blade treated pursuant to this invention.

The coatings of the present invention can be applied to the substrate through the use of any suitable thermal spray technique including detonation gun (D-gun) deposition, continuous flame spray deposition, thermal plasma torch deposition or any deposition process wherein the coating in the form of a powder is contacted with hot gases to heat it and is then impinged upon the substrate.

In the thermal plasma torch process, an electric arc is established between two spaced non consumable electrodes as gas is passed in contact with the non-consumable electrodes such that it contains the arc. The arc-containing gas or plasma is constricted by a nozzle and results in a high thermal content effluent. Powdered coating material is injected into the plasma torch and is projected through the nozzle and deposited onto the surface to be coated. This process, examples of which are described in U.S. Pat. Nos. 2,858,411 and 3,016,447, can produce deposited coatings which are sound, dense and adherent to the substrate. The applied coating also consists of irregularly shaped microscopic splats or leaves which are interlocked and mechanically bonded to one another and also to the substrate.

The substantially higher hot gas temperatures in the first stage of the method of this invention are obtained in the thermal plasma torch process by increasing the power input to the electrodes of the torch and lower temperatures as used in the second stage are produced by reducing the power input to the electrodes. This is conveniently achieved by holding the voltage generally constant in the first and second stages while using a higher current in the first stage and a lower current in the second stage. Also, it may be possible to change the torch gas composition (for example, adding hydrogen or helium) and to increase both the voltage and current. The power input in the first stage, preferably, is at least about 20%, most preferably, at least about 30%, greater than the power input to the second stage. For example, if the power input to the second stage is 9 kw, a 20% greater power input to the second stage would be 10.8 kw and a 30% greater input to the second stage would be 11.7 kw. In the illustration given above the current in the second stage would be about 153 amps at 59 Volts, a 20% greater current for the first stage would be about 184 amps at 59 Volts and a 30% greater current for the first stage would be about 199 amps at 59 Volts. Since temperatures produced in the plasma of a given thermal plasma spray device are proportional to the power input, the plasma temperatures in the first stage are preferably 20%, most preferably 30%, greater than plasma temperatures in the first stage.

The thickness of coating in the first stage is not narrowly critical. However, it is necessary to fully cover the entire surface intended to be coated. Illustratively the thickness of the coating in the first stage can range from 2% to 25%, most preferably 4% to 15%, of the total thickness of coating deposited by the first and second stages. The total thickness of coating deposited in both stages also is not narrowly critical and is selected by the skilled worker based upon the properties desired for a given application. Representative total thicknesses of the coating deposited in both stages range from 0.002 to 0.02 inch, but in some applications may be as high as and exceed 0.2 inch.

While not being limited by theoretical explanation, because the velocity and fluidity of the molten particles in the first stage are higher than in the second stage because of higher hot gas temperatures, it is believed that better mechanical interlocking of the coating to the substrate is obtained in the first stage. Furthermore the average temperature of the heated particles is higher in the first stage, which, it is believed, results in increased welding or chemical bonding of the coating to the substrate. However, as the coating achieves greater thickness in the first stage, it develops higher and higher residual tensile forces. The present invention promotes greater bonding or adhesion by depositing the first layer or first few layers of particle splats at high temperature in the first stage while avoiding high residual tensile stresses by depositing subsequent layers making up the desired thickness at lower temperatures in the second stage, i.e., employing the optimum coating parameters which are most desirable if bonding is not an issue.

The D-gun process, an example of which is described in U.S. Pat. No. 2,714,563, deposits a circle of coating on the substrate with each detonation. The circles of coating are about 1 inch (25 mm) in diameter and a few ten thousandths of an inch thick. Each circle of coating is composed of microscopic splats corresponding to the individual powder particles. The splats interlock and mechanically bond to each other and the substrate without substantially alloying at the interface thereof. The placement of the circles in the coating deposition are closely controlled to build up a smooth coating of uniform thickness to minimize substrate heating and residual stresses in the applied coating.

The temperature of the hot gases formed by the combustion of a combustible gas, i.e., fuel gas, in the D-gun can be controlled by varying oxygen to carbon (in the combustible gas) mole ratio and/or the introduction into the D-gun of controlled amounts of a non-combustible, diluent gas such as nitrogen, argon, etc. Lower hot gas temperatures are achieved by increasing the amount of diluent gas introduced, and/or by decreasing the oxygen to carbon (in the fuel gas) mole ratio in the range of 1.5 to 1.0, and higher hot gas temperatures are achieved by decreasing the amount of diluent gas introduced and/or by increasing the oxygen-carbon (in the fuel gas) mole ratio in the range of 1.5 to 1.0.

In the continuous flame spray process, a stream of coating particles is heated by burning a fuel-oxygen mixture and is propelled toward the surface of the substrate to be coated at high temperatures and velocities greater than 500 feet per second. The process, an example of which is described in U.S. Pat. No. 2,861,900, can produce a substantially non-porous tungsten carbide coating.

The temperature of the hot gases formed by the continuous combustion of gases in the continuous flame spray device can be controlled by changing the gas flow rate and/or by varying the fuel gas-oxygen ratio. Lower hot gas temperature can be achieved by reducing the gas flow rate and/or by deviation of the fuel gas-oxygen mole ratio from the stoichiometric ratio and higher hot gas temperature are achieved by increasing the gas flow rate and/or by making the fuel gas-oxygen mole ratio equivalent to the stoichiometric ratio.

The coatings of the present invention may be applied to almost any type of substrate, e.g., metallic substrates such as iron or steel or non metallic substrates such as carbon, graphite or polymers, for instance. Some examples of substrate material used in various environments and admirably suited as substrates for the coatings of the present invention include, for example, steel, stainless steel, iron base alloys, nickel, nickel base alloys, cobalt, cobalt base alloys, chromium, chromium base alloys, titanium, titanium base alloys, aluminum, aluminum base alloys, copper, copper base alloys, aluminide nickel-based alloys, refractory metals and refractory-metal base alloys.

More specifically, substrates that may be coated pursuant to this invention are refractory metals and alloys including Ti, Zr, Cr, V, Ta, Mo, Nb and W, superalloys based on Fe, Co or Ni including Inconel 718, Inconel 738, Waspaloy and A-286, stainless steels including 17-4PH, AISI 304, AISI 316, AISI 403, AISI 422, AISI 410, AM 350 and AM 355, Ti alloys including Ti-6Al-4V and Ti-6Al-2Sn-4Zr-2Mo and Ti-8Al-1-Mo-1V, aluminum alloys including 6061 and 7075, WC-Co Cermet, and A1203 ceramics. The above-identified substrates are described in detail in *Materials Engineering-/Materials Selector* '82, published by Penton/IPC, subsidiary of Pittway Corporation, 1111 Chester Ave., Cleveland, Ohio 44114, in 1981, and *Alloy Digest*, published by Alloy Digest, Inc., Post Office Box 823, Upper Montclair, N.J., in 1980. Furthermore, any substrate that is able to withstand the temperatures and other conditions of the thermal spray can be used in the method and coated articles of this invention.

Suitable coating materials in particulate (powder) form include particles of metals, e.g., Si, Cu, Al, W, Mo, Cr, Ta, Nb, V, Hf, Zr, Ti, Ni, Co, Fe and their alloys including alloying elements Mn, Si, P, Zn, B and C. Substantially any metal, either elemental or alloy, which can be softened or melted without decomposition by the thermal spray apparatus can be employed. The powder or particles used for plasma torch, continuous flame spray device and D-gun deposition has a representative particle size ranging between 5 and 200 microns. Optimum particle size is believed to be that which permits virtually all the particles to be softened enough to give good adherence but does not permit excessive vaporization of the particles. Generally, materials of lower melting points, such as lead, tin, zinc, aluminum and magnesium may be of larger particle size, e.g., up to 150 microns, and those of higher melting point, such as, chromium, tungsten and tungsten carbide, are used when smaller than about 50 microns to produce dense adherent coatings. However, these size examples are not critical. In order to achieve uniform heating and acceleration of a single component powder, it is advisable to use a powder having as narrow a particle size distribution as possible.

The inert gas used in the thermal plasma torch method can include argon or nitrogen or mixtures of either one or both of these with hydrogen or helium. Actually, any suitable inert gas can be employed. The anode of the plasma torch is made of any suitable metal, usually copper, and the cathode is made of any suitable metal, usually thoriated tungsten. The inert gas flows around the cathode and through the anode which serves as a constricting nozzle. A direct current arc is maintained between the electrodes, the arc current and voltage used vary with the design of the anode and cathode, gas flow and gas composition.

The gas plasma generated by the arc consists of free electrons, ionized atoms, and some neutral atoms and, if nitrogen or hydrogen are used, undissociated diatomic molecules. The specific anode/cathode configuration, gas density, mass flow rate and current/voltage determine the plasma temperature and gas velocity. In the improvement of the present invention, variation of the current/voltage supplying the arc is a convenient way for increasing or decreasing plasma temperature. The combination of particle plasticity, fluidity, and velocity is made high enough to allow the particle to flow, upon impact on the substrate surface, into a thin, lenticular shape that molds itself to the topology of the substrate surface or previously deposited material on the substrate surface. It is desirable not to heat the powder to an excessive temperature such that all or part of the powder is vaporized or partially vaporized. The temperature of the hot plasma produced by the plasma torch is best controlled by controlling the amount of current used in forming the arc. Higher currents for any given plasma torch, powder, gas flow rate and composition result in higher temperatures and lower temprates are produced by lower currents.

In a typical torch having a copper anode formed with a bore having a diameter of 0.4 inch and a nozzle having a 0.125 inch orifice and a 2% thoriated tungsten cathode having a 0.12 inch diameter, argon gas under pressure is passed through the anode and through the nozzle in the annular space between the cathode and the anode and a metal powder is injected into the plasma torch. The plasma and powder are projected against the substrate. Such apparatus would be operated at a current and voltage which are found to be optimum for a given coating and substrate by the above-mentioned optimization procedure. The coating produced on the substrate using the optimum current throughout the coating operation results in a coating that fails under a Type I failure wherein the coating spalls along the interface between the coating and the substrate. Attempts to improve adhesion of the coating to the substrate by increasing the power input to the electrodes by raising the current results in a coating having high residual tensile stress and which is prone to cracking, breaking and spalling off. The present invention eliminates these problems by applying one or more layers of coating of a fraction of the ultimate desired thickness applied with a current substantially higher than said optimum current. After one or two or a few passes forming layers of "splats" which fully cover the entire surface intended to be coated at the higher-than-normal current, the current is then decreased to the normal level as explained above and the remaining thickness of the coating is built up at the lower current.

The following examples are presented. In the examples, the following terms have the meanings given below:

x-traverse: speed of torch nozzle parallel to the surface of substrate being coated.

surface speed: relative speed of the substrate past the nozzle.

standoff: distance from the torch nozzle to the substrate.

T.P.: torch pressure in psig, the pressure of the inert gas supplied to the anode bore.

D.P.: powder dispenser pressure in psig, the pressure of the inert gas in the powder dispenser feeding powder to the nozzle.

T.V.: torch voltage in volts between the anode and cathode.

T.C.: torch current in amperes applied to the electrodes.

S.P.: shield pressure in psig, the pressure of inert gas around the plasma shielding it from the atmosphere.

Preparation: The substrates coated in each of the following examples except 4 and 5 were first grit-blasted using alumina particles having an average particle size of 250 microns at 30 psig for one or two passes. Then, they were cleaned in an ultrasonic cleaner to reduce the amount of loosely attached alumina particles. Thereafter, the substrate was ready for coating.

Post Treatment: The coated substrates in each of the following examples were subjected to a post heat treatment for 4 hours at 1975° F. under vacuum.

EXAMPLE 1

In this example, the substrate was a burner bar made of a nickel-based alloy containing 12.25 wt. % tantalum, 10.5 wt. % chromium, 5.5 wt. % cobalt, 5.25 wt. % aluminum, 4.25 wt. % tungsten, 1.75 wt. % titanium, nominal amounts of manganese, silicon, phosphorus, sulfur, boron, carbon, iron, copper, zirconium and hafnium totaling 0.7785 wt. % and the balance nickel and precoated with a diffused aluminide coating applied by gas phase diffusion in which high amounts of aluminum were reacted with the nickel alloy. The coating powder was a nickel-based alloy containing 22 wt. % cobalt, 17 wt. % chromium, 12.5 wt. % aluminum, nominal amounts of hafnium, silicon and yttrium totaling 1.25 wt. % and the balance nickel. The coating powder had an average particle diameter of 25 microns and a particle diameter distribution of from 2 microns to 45 microns. In this example, the burner bar after the preparation treatment described above was coated by a total of 20 passes of the burner bar past the thermal plasma spray torch described hereinabove. The first two passes (first stage) were made with the plasma spray torch operating at 200 amps (power input of 11.8 kw) and the remaining 18 passes, that is, passes 3–20, (second stage) were carried out at 150 amps (power input of 8.85 kw). The torch characteristics and parameters are given below:

| First and Second Stages: | | | | |
|---|---|---|---|---|
| voltage | | 59 to 62 volts | | |
| gas rate through anode bore | | 290 cubic feet per hour | | |
| powder feed rate | | 20 grams per minute | | |
| x-traverse | | 0.083 inch per second | | |
| standoff | | 0.5 inch | | |
| surface speed | | 7500 inch/minute | | |
| First stage: | T.P. | D.P. | T.C. | S.P. |
| (2 passes) | 60 | 45 | 200 | 76 |
| Second stage: | T.P. | D.P. | T.C. | S.P. |
| (18 passes) | 57 | 42 | 150 | 76 |

The first stage layer was about 10 microns thick and the second layer was about 110 microns thick.

The resulting coated substrate was post heat treated at 1975° F. under vacuum for 4 hours. The resulting nickel-based alloy coating had excellent adhesion to the substrate, i.e., the nickel alloy burner bar having the diffused aluminide precoating applied by gas phase deposition, and had a low residual stress and high resistance to spalling, cracking or breaking before and after post heat treatment. In contrast, the same type of nickel-based coatings applied to the same type of aluminide precoated nickel-based alloy burner bars under the second stage conditions, i.e., 150 amperes current input, throughout the total 20 passes adhered very poorly to the aluminide precoated substrate.

EXAMPLE 2

A substrate, burner bar, of the same type coated in Example 1 (after the preparation treatment) was coated with two passes of the coating powder described in Example 1 using approximately the same conditions as described in Example 1 with the exception that the second stage conditions were as follows:

| T.P. | D.P. | T.V. | T.C. | S.P. |
|---|---|---|---|---|
| 59 | 44 | 61 | 150 | 75 |

and twenty passes were made in the second stage. The coated burner bar was subjected to the post heat treatment described in Example 1. The resulting coating exhibited excellent adhesion, low residual tensile stress and excellent resistance to spalling, cracking and flaking off before and after post heat treatment.

EXAMPLE 3

A substrate, a turbine blade, made of the same material as and aluminized in the same manner as the burner bar described in Example 1, after the preparation treatment described hereinabove, was coated with the coating powder described in Example 1 using approximately the same conditions as disclosed in Example 1 with the exceptions that the first stage comprised four passes under the conditions given below and the second stage comprised 24 passes under the conditions given below.

| | | | | | |
|---|---|---|---|---|---|
| First stage: | T.P. | D.P. | T.V. | T.C. | S.P. |
| (4 passes) | 60 | 45 | 59 | 200 | 76 |
| Second stage: | T.P. | D.P. | T.V. | T.C. | S.P. |
| (12 passes) | 58 | 41 | 59 | 150 | 75 |
| Second stage (continued): | T.P. | D.P. | T.V. | T.C. | S.P. |
| (12 more passes) | 59 | 42 | 60 | 150 | 75 |

After coating and before post heat treatment the coating on the blade showed no signs of flaking off. The coated blade was then subjected to post heat treatment after which it was inspected visually with the naked eye and under a macroscope having a magnification range of 6× to 31×. The coating was observed to be well adhered to the blade and there were no signs of peeling off. The coating on the coated blade was also observed to have low residual tensile stress and superior resistance to cracking, spalling or breaking.

EXAMPLE 4

Two turbine blades, made of the same material as, and aluminized in the same manner as, the burner bar described in Example 1, were grit-blasted with 240 mesh 3-18-87 C.T.K. alumina grit, abraded with a Scotch-Brite wheel on the 3-18-87 C.T.K. concave side and further treated in a vibratory finisher to remove any residual oxide grit left from the grit blasting. Both blades were coated with the coating powder described in Example 1. The coating conditions for the first blade were the same as those used in Example 1 with the exceptions given below:

| | | | | | |
|---|---|---|---|---|---|
| First stage: | T.P. | D.P. | T.V. | T.C. | S.P. |
| (2 passes) | 60 | 45 | 59 | 200 | 76 |
| Second stage: | T.P. | D.P. | T.V. | T.C. | S.P. |
| (32 passes) | 47 | 42 | 59 | 120 | 79 |

Figure 2:
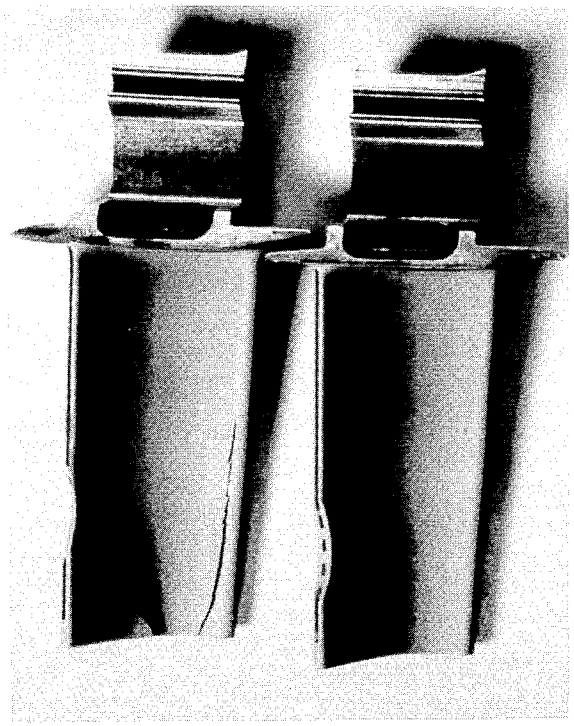
FIG. 2 is a photograph showing the concave side of the two blades shown in FIG. 1, the upper blade treated pursuant to this invention.

The coating conditions for the second blade are same as above except the 200 ampere passes were not used (i.e., a total of 34 passes at 120 amperes were used). After coating there was no sign of separation on the first blade, which was coated at the combination of 200 amperes (2 passes) and 120 amperes (32 passes), but the coating on the second blade (coated with 34 passes at 120 amperes only) showed signs of lifting off both sides of the blade, as shown in FIGS. 1 and 2.

EXAMPLE 5

In this Example, the substrates were two stress cylinders each having a longitudinal slit and made of carbon steel sheet. Each of the stress cylinders was secured so that the edges of the longitudinal slit abutted. Both stress cylinders were coated to a coated thickness of 0.004 inch using the coating powder described in Example 1. For the first stress cylinder, the coating was applied by operating the plasma spray torch at 200 amperes under the conditions given in Example 1. The second stress cylinder was coated using 150 amperes under the conditions given in Example 1. Each of the securing means for the cylinders was released allowing the longitudinal edges of each cylinder to separate thereby forming a longitudinal slit. The width of the slit changed the diameter of the cylinder and the diameter of each cylinder was measured before and after the coating was applied. The change in the diameter of the cylinder was used to estimate the level of the residual tensile stress in the coating. The results of this test showed that the coating had higher residual tensile stress when 200 amperes was used.

Further, it also was found that the life of the anode in the plasma spray torch was greatly reduced when the torch was operated at 200 amps continuously.

What is claimed is:

1. A method of thermal spraying a multilayer coating on a substrate to improve the adherence of the coating to the substrate and provide improved low residual stress in the coating by projecting heat-softened particles onto said substrate comprising the steps of:

(a) establishing a body of hot gases, (b) contacting said hot gases with particles to be projected and coated onto said substrate, (c) heating said particles in said hot gases to a temperature above their melting point, (d) impinging said heated particles against a substrate selected from the group consisting of metallic, carbon, graphite or polymer substrates for a period of time sufficient to provide a first layer of a coating on said substrate, (e) reducing the heat of said particles in said hot gases to a temperature below that of step (c) but above about their melting point, and (f) impinging said heated particles on said first layer to provide an overall layer having good adhesion to said substrate and wherein the thickness of the coating deposited in step (d) is from 2 percent to 25 percent of the total thickness of the overall layer.

2. The method of claim 1 wherein the temperature of the particles of step (c) is at least 10 percent higher than the temperature of the particles in step (e).

3. The method of claim 1 wherein in step (a) a thermal plasma torch process is used for establishing said hot gases by using an electric arc between two non-consumable electrodes and enveloping the arc in a gas stream and wherein the temperature of the hot plasma is varied by varying the power input to the electrodes.

4. The method of claim 3 wherein the power input for the thermal plasma torch in step (c) is at least 20 percent greater than the power input for the thermal plasma torch in step (e).

5. The method of claim 4 wherein said power input for the thermal plasma torch in step (c) is at least 30 percent greater than the power input for the thermal plasma torch in step (e).

6. The method of claim 3 wherein said power input for the thermal plasma torch in step (c) is at least about 12 kw and the power input for the thermal plasma torch in step (e) is about 9 kw.

7. The method of claim 3 wherein the gas flow rate and composition of the gases across the electrodes in steps (c) and (e) are generally constant and the current fed to the electrodes in step (c) is at least about 20 percent higher than the current fed to the electrodes in step (e).

8. The method of claim 6 wherein the gas flow rate and composition of the gases across the electrodes in steps (c) and (e) are generally constant and the current fed to the electrodes in step (c) is at least about 30 percent higher than the current fed to the electrodes in step (e).

9. The method of claim 7 wherein the voltage of the thermal plasma torch is about 59 volts and the current in said thermal plasma torch for step (c) is about 200 amperes and the current for step (e) is about 150 amperes.

10. The method of claim 1 wherein in step (a) a detonation gun deposition process is used for establishing said hot gases by using the combustion of a combustible gas and wherein the temperature of the hot gases can be varied by diluting said combustible gas with a non-combustible gas.

11. The method of claim 1 wherein in step (a) a detonation gun deposition process is used for establishing said hot gases by using the combustion of a combustible gas, said combustible gas being a mixture of a carbon containing gas and oxygen and wherein the temperature of the hot gases can be varied by varying the oxygen to carbon mole ratio in the range of 1.5 to 1.0.

12. The method of claim 11 wherein the temperature of the hot gases can be varied by diluting the combustible gas with a non-combustible gas.

13. The method of claim 1 wherein in step (a) a continuous flame spray deposition process is used for establishing said hot gases by using the combustion of a combustible gas, said combustible gas being a mixture of a carbon containing gas and oxygen and wherein the temperature of the hot gases can be varied by varying the total gas flow rate or varying the oxygen to carbon mole ratio in the range of 1.5 to 1.0.

14. The method of claim 1 or 2 wherein said substrate is an alloy selected from the group consisting of a nickel-based alloy, a cobalt-based alloy and an iron-based alloy.

15. A coated article comprising a substrate having a coating applied by the method claimed in claims 1, 3, 10, 11 or 13.

16. The coated article of claim 15 wherein said substrate is selected from the group consisting of a turbine vane, a turbine blade and a turbine shroud.

* * * * *

UNITED STATES PATENT AND TRADEMARK OFFICE

CERTIFICATE OF CORRECTION

PATENT NO. : 4,788,077

DATED : November 29, 1988

INVENTOR(S) : Chih-Tsung Kang

It is certified that error appears in the above-identified patent and that said Letters Patent is hereby corrected as shown below:

Page 1, [54] - "ADDHERENCE" should read "ADHERENCE"

Column 2, line 60 - "reatly" should read "greatly"

Column 3, line 10 - "enerating" should read "generating"

Column 4, line 3 - "ried out in first and second stages a single coating mate-" should read "ried out in first and second stages using a single coating mate-"

Column 7, line 23 - "Ti-8Al-1-Mo-1V" should read "Ti-8Al-1Mo-1V"

Signed and Sealed this

Twenty-third Day of May, 1989

*Attest:*

*Attesting Officer*

DONALD J. QUIGG

*Commissioner of Patents and Trademarks*